United States Patent [19]

Kamio et al.

[11] Patent Number: 4,547,459

[45] Date of Patent: Oct. 15, 1985

[54] PHOTOGRAPHIC SILVER HALIDE MATERIALS CONTAINING A HIGH SPEED COATING AID

[75] Inventors: Takayoshi Kamio; Kunihiko Ohga; Yasuo Mukunoki, all of Kanagawa, Japan

[73] Assignee: Fuji Photo Film Co., Ltd., Japan

[21] Appl. No.: 309,362

[22] Filed: Oct. 7, 1981

[30] Foreign Application Priority Data

Oct. 8, 1980 [JP] Japan ..... 55-140967

[51] Int. Cl.[4] ..... G03C 1/72

[52] U.S. Cl. ..... 430/631; 430/529; 430/539; 430/546

[58] Field of Search ..... 430/529, 539, 546, 631

[56] References Cited

U.S. PATENT DOCUMENTS 4,056,396 11/1977 Horie et al. ..... 430/631

4,347,308 8/1982 Takeuchi et al. ..... 430/529

*Primary Examiner*—Jack P. Brammer

*Attorney, Agent, or Firm*—Sughrue, Mion, Zinn, Macpeak, and Seas

[57] ABSTRACT

A photographic silver halide light-sensitive material is disclosed comprising a support and at least one silver halide emulsion layer on the support, wherein the emulsion layer or another hydrophilic organic colloid layer contains a compound represented by formula (I)

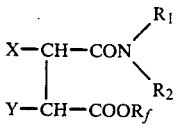

(I)

wherein $R_1$ and $R_2$ represent the same or different groups and are each hydrogen, an alkyl group, or an aryl group, or $R_1$ and $R_2$ can be linked together to form an N-containing heterocyclic ring, provided that $R_1$ and $R_2$ are not both hydrogens; $R_f$ is a fluorine-containing group; one of X and Y is a hydrogen atom and another is a $—SO_3M$ group wherein M is a cation.

A method for high speed coating a photographic emulsion or another hydrophilic organic colloid composition is also disclosed wherein the improvement comprises a compound represented by formula (I) to the emulsion or the composition.

7 Claims, No Drawings

PHOTOGRAPHIC SILVER HALIDE MATERIALS CONTAINING A HIGH SPEED COATING AID

FIELD OF THE INVENTION

The present invention relates to photographic light-sensitive materials, and more particularly to photographic silver halide light-sensitive materials containing sulfonic acid-based surface active agents as coating aids in a hydrophilic organic colloid coating layer thereof.

BACKGROUND OF THE INVENTION

In general, as supports for photographic light-sensitive materials, synthetic polymeric substances such as cellulose ester, polystyrene, polycarbonate and polyethylene terephthalate, glass, paper, and poly-α-olefin coated paper are used. These supports are coated directly or through a subbing layer with a photographic silver halide emulsion layer. In many light-sensitive materials, a surface protective layer is coated on the photographic emulsion layer in order to prevent sticking of the light-sensitive material or among light-sensitive materials, and to prevent scratches during processing. In addition, coating layers composed of gelatin or other hydrophilic colloids, or vinyl polymer latex containing various additives such as dyes, antistatic agents, hardeners, color-forming couplers, and halation-preventing agents, e.g., an antihalation layer, an intermediate layer, a filter layer, and an antistatic layer are typically coated.

Thus, the usual photographic light-sensitive materials are composed of many hydrophilic organic colloid layers. In producing such photographic light-sensitive materials, therefore, it is required that coating solutions are coated uniformly at a high speed without causing troubles such as repellency and uneven coating to form thin organic colloid layers.

Furthermore, in the production of photographic light-sensitive materials, multilayer coating is often employed in which photographic emulsions and coating solutions containing hydrophilic organic colloid, e.g., gelatin, are coated at the same time. For example, photographic emulsion layers having different light-sensitive regions are continuously coated to prepare a color photographic light-sensitive material. When gelatin or other organic colloid solutions are coated on organic colloid (e.g., gelatin) layers, greater difficulty is encountered in obtaining the necessary coating characteristics compared with the case wherein a gelatin colloid solution is coated directly on a support. This difficulty arises particularly in the case of the underlying coated layers being present in the state that they are just after coating and being cooled.

In the case of color photographic light-sensitive materials, many water-sparingly-soluble additives such as color couplers, ultraviolet ray absorbing agents, and fluorescent whitening agents are dissolved in high boiling point organic solvents such as phthalate-based compounds and phosphate-based compounds, dispersed (or emulsified) in a solution of hydrophilic organic colloid, particularly gelatin in the presence of a surface active agent, and incorporated into a hydrophilic organic colloid layer. In this case, when a large amount of surface active agent is used as the emulsifying agent, it becomes difficult to coat additional other hydrophilic organic colloid layers on the hydrophilic organic colloid layer, whereas when the amount of the emulsifying agent being added is small, the photographic properties of the photographic light-sensitive material after the coating thereof become instable.

Various surface active agents have heretofore been used as coating aids for various coating solutions for use in the preparation of photographic light-sensitive materials, as emulsifying agents, or as additives to improve the surface characteristics of a photographic surface layer. In particular, saponin has been widely used as a coating aid in the photographic industry. The saponin, however, has disadvantages in that it is responsible for easy formation of foams, the quality varies markedly since it is a natural product, and the characteristics as a coating aid are poor. With other synthetic surface active agents, the action thereof on various coating solutions, or on the coating and surface characteristics of the photographic coating layer varies depending on the type of the surface active agent. This imposes limitations on the range of applications in which they can be used. Suitable surface active agents, therefore, are selected and utilized according to the particular individual application itended.

Examples of such surface active agents are described, for example, in U.S. Pat. Nos. 2,240,469, 2,240,492, 2,240,475, 3,026,202, 3,169,879, 3,201,252, 3,165,409, 3,507,660, 3,539,352, 3,516,835, 3,619,119, 3,824,102, and 2,992,108, and Japanese Patent Application (OPI) Nos. 46733/74 and 3233/76 (the term "OPI" as used herein refers to a "published unexamined Japanese patent application"). These surface active agents, however, are not completely satisfactory, in that they deteriorate the photographic characteristics, particularly the physical properties of a film, at high temperatures and humidities, and in that the stability of the surface active agent per se is poor and high speed coating properties are insufficient.

SUMMARY OF THE INVENTION

An object of the present invention is to provide a photographic light-sensitive material which is improved in coating characteristics such as prevention of repellency and uniformity when a gelatin-containing solution or another hydrophilic organic colloid solution, which is difficult to coat, as described hereinbefore, is coated on a support such as a film, paper, or another photographic layer.

Another object of the present invention is to provide a method which enables high speed coating of a photographic emulsion or another hydrophilic organic colloid composition without causing problems such as foaming and repellency.

The term "repellency" is used in the present invention to mean that in providing a hydrophilic organic colloid layer, fine areas where a coating solution is not coated (for reasons such as leakage and surface tension) are formed.

A further object of the present invention is to provide a method which facilitates the coating of additional second and third hydrophilic organic colloid layers on a first hydrophilic organic colloid layer containing a water-sparingly-soluble (i.e., sparingly soluble in water) photographic additive dissolved in a high boiling point organic solvent.

Still another object of the present invention is to provide a method for producing a photographic light-sensitive material with which no foaming occurs during development treatment and which substantially does not result in formation of insoluble materials.

Other objects and the effects of the present invention will become apparent from the following explanation.

It has been found that these objects are attained by incorporating a compound represented by formula (I) shown below into a hydrophilic organic colloid layer, viz.,

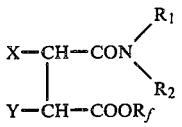

(I)

wherein $R_1$ and $R_2$ represent the same or different groups and are each hydrogen, an alkyl group (which may be substituted), or an aryl group (which may be substituted), and may be linked together to form an N-containing heterocyclic ring, provided that $R_1$ and $R_2$ are not both hydrogens; $R_f$ is a fluorine-containing alkyl group (which may be substituted); one of X and Y is a hydrogen atom and another is a $—SO_3M$ group wherein M is a cation.

DETAILED DESCRIPTION OF THE INVENTION

The present invention, therefore, provides a photographic silver halide light-sensitive material comprising a support and at least one silver halide emulsion layer on the support wherein the emulsion layer or another hydrophilic organic colloid layer contains a compound represented by formula (I)

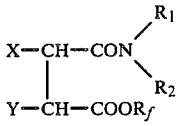

(I)

wherein $R_1$ and $R_2$ represent the same or different groups and are each hydrogen, an alkyl group (which may be substituted), or an aryl group (which may be substituted), and may be linked together to form an N-containing heterocyclic ring, provided that $R_1$ and $R_2$ are not both hydrogens; $R_f$ is a fluorine-containing alkyl group (which may be substituted; one of X and Y is a hydrogen atom and another is $—SO_3M$ wherein M is a cation.

Preferred examples of $R_1$ and $R_2$ are hydrogen, substituted or unsubstituted alkyl groups containing from 1 to 30 carbon atoms (examples of substituents include an alkoxy group, a halogen group, an aryl group, and an aryloxy group), and substituted or unsubstituted aryl groups containing from 6 to 24 carbon atoms (examples of substituents include an alkyl group, an alkoxy group, and a halogen group). $R_1$ and $R_2$ may be linked together to form an N-containing ring. Examples of such N-containing rings include a piperidine ring and an N-alkylpiperazine ring.

Preferred examples of $R_f$ are alkyl groups containing 4 or more fluorine atoms and from 3 to 30 carbon atoms. These alkyl groups may contain the same substituents as described for the alkyl group of $R_1$ and $R_2$. Of these compounds, these alkyl groups may be substituted solely by fluorine atoms.

Preferred examples of M include hydrogen, an alkali metal cation, an alkaline earth metal cation, ammonium, and amino groups. More preferred examples include $Na^{\oplus}$, $K^{\oplus}$, $\frac{1}{2}Ca^{\oplus\oplus}$, $^{\oplus}NH_4$, $C_2H_5{}^{\oplus}NH_3$, $^{\oplus}NH(C_2H_5)_3$, and $HO\text{-}CH_2CH_2{}^{\oplus}NH_3$. Particularly preferred example is $Na^{\oplus}$.

The compound of the present invention has a structure which is clearly different from that of the diester type compound as described in Japanese Patent Application (OPI) No. 32322/76. The fact that conversion of the diester type into the ester-amide type produces such favorable effects that could not be expected. That is, the compound of the present invention represented by formula (I) has excellent surface activity (particularly dynamic surface tension) and exerts no adverse influences (e.g., an increase in viscosity and formation of foams) on a coating solution. The use of the compound of the present invention improves high speed coating properties and permits performing the coating, for example, at a rate of 70 m/minute or more, and enables the production of an excellent photographic film without causing repellency and uneven coating. Furthermore, when the compound of the present invention is used, charging properties are improved. In this respect, the compound of the present invention is also a very useful material.

In accordance with the present invention, foaming and formation of insoluble materials arising in performing a development treatment can be prevented and a film having excellent properties can be produced.

Furthermore, the present invention has a great advantage in that the desired compound of the present invention can be prepared in high purity and high yield, since an intermediate compound for the preparation of the compound can generally be prepared in high purity and high yield.

Preferred examples of anionic surface active agents represented by formula (I) which can be used in the present invention are shown below, although the present invention is not limited thereto.

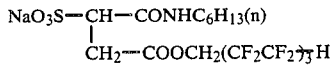

Compound (1)

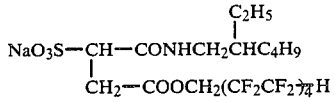

Compound (2)

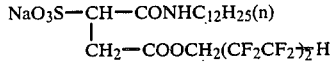

Compound (3)

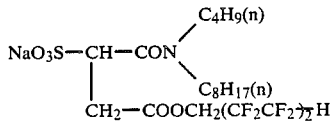

Compound (4)

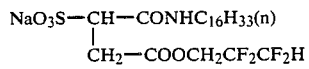

Compound (5)

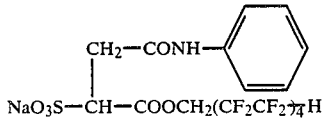

Compound (6)

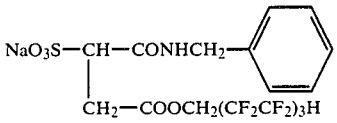

Compound (7)

-continued

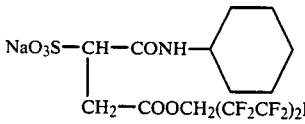

Compound (8)

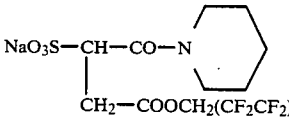

Compound (9)

$NaO_3S-CH(CH_2-COOCH_2(CF_2CF_2)_2H)-CONHC_{12}H_{25}(n)$ Compound (10)

$NaO_3S-CH(CH_2-COO-CH(CH_3)-CF_2CF_2H)-CONHC_{12}H_{25}(n)$ Compound (11)

$NaO_3S-CH(CH_2-COOCH_2CF_2CF_3)-CONHC_{12}H_{25}(n)$ Compound (12)

$KO_3S-CH(CH_2COOCH_2(CF_2CF_2)_3H)-CONHC_8H_{17}(n)$ Compound (13)

$NaO_3S-CH(CH_2-COOCH_2CH_2NHSO_2C_8F_{17})-CONHC_8H_{17}(n)$ Compound (14)

$NaO_3S-CH(CH_2-COOCH_2CH_2NHCO(CF_2CF_2)_3H)-CONHC_8H_{17}(n)$ Compound (15)

$NaO_3S-CH(CH_2-COOCH_2CH_2(CF_2CF_2)_2F)-CONH-CH(C_2H_5)-C_5H_{11}$ Compound (16)

$NaO_3S-CH(CH_2-COCH_2CH_2(CF_2CF_2)_4F)-CONH-C_6H_{13}(n)$ Compound (17)

Compounds represented by formula (I) which is used in the present invention is usually synthesized by the following procedure.

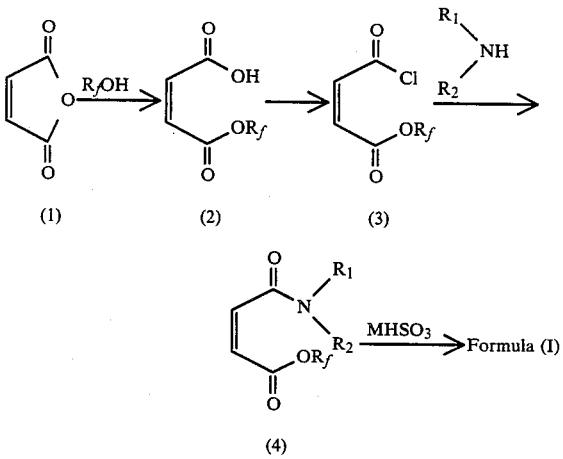

Maleic anhydride (1) and a fluorine-containing alcohol ($R_fOH$) are reacted to prepare a monoester compound (2). The monoester compound (2) is converted into monoacid chloride (3) and, thereafter, is reacted with a primary or secondary amine to prepare a compound (4). Addition of hydrogensulfurous acid salt of the cation ($MHSO_3$) to the compound (4) provides the desired compound represented by formula (I).

Hereinafter, examples of preparation of the compounds of the present invention are shown below.

PREPARATION EXAMPLE 1

Preparation of Compound (1)

To a mixture of 39.2 g of maleic anhydride and 132.8 g of dodecafluoroheptanol, 55 ml of triethylamine was dropwise added over a period of 30 minutes while stirring the mixture and maintaining the temperature thereof at 15° C. or less. After the mixture was stirred for additional 4 hours, it was poured into a dilute hydrochloric acid solution (prepared by diluting 35 ml of concentrated hydrochloric acid with 500 ml of water). Crystallized crystals were collected and filtered off, and 150 g of a monoester of maleic acid was thus obtained.

Then, 21.5 g of the monoester compound thus-prepared was dissolved in 50 ml of benzene, and 10.5 g of phosphorus pentachloride was added thereto while cooling with ice. After the mixture was allowed to stand overnight, the benzene and by-produced phosphorus oxychloride were distilled off under reduced pressure, to obtain 22.3 g of an acid chloride of maleic acid monoester.

Then, 22.3 g of the acid chloride was dissolved in 70 ml of acetone with stirring, and a mixture of 5.2 g of n-hexylamine and 7 ml of triethylamine was added thereto while maintaining the temperature of the resulting mixture at 15° C. or less. The reaction mixture was stirred at room temperature for an additional 1 hour and poured into water. An oily product separated was extracted with ethyl acetate and washed with water twice, and the ethyl acetate layer was then concentrated under reduced pressure to obtain 25.5 g of maleic ester amide as an oily material.

Then, 20.5 g of the maleic ester amide prepared above was mixed with 5 g of sodium hydrogensulfite, 6 ml of water, and 10 ml of ethanol. The resulting mixture was refluxed for 10 hours to obtain a uniform solution. After the reaction mixture solution was concentrated under reduced pressure, 50 ml of ethanol was added thereto, and insoluble products were filtered off and the ethanol was distilled away under reduced pressure to obtain 24.0 g of Compound (1).

PREPARATION EXAMPLE 2

Preparation of Compound (3)

To a mixture of 49 g of maleic anhydride and 116 g of octafluoropentanol, 70 ml of triethylamine was dropwise added while stirring and maintaining the temperature thereof at 15° C. or less. After the mixture was stirred for additional 4 hours, it was poured into a dilute hydrochloric acid solution (prepared by diluting 45 ml of concentrated hydrochloric acid with 500 ml of water). Deposited crystals were collected and filtered off to obtain 151 g of maleic acid nomoester.

Then, 16.5 g of the monoester compound thus-prepared was dissolved in 50 ml of benzene, and 10.5 g of phorphorus pentachloride was added thereto, while cooling with ice. After the mixture was allowed to stand overnight, the benzene and by-produced phosphorus oxychloride were distilled away under reduced pressure to obtain 17.5 g of an acid chloride of maleic acid monoester.

Then, 17.5 g of the acid chloride thus-prepared was dissolved in 70 ml of acetone with stirring, and a mixture of 9.3 g of n-dodecylamine and 7 ml of triethylamine was dropwise added thereto while maintaining the temperature of the resulting mixture at 15° C. or less. The reaction mixture was stirred at room temperature for additional 1 hour, and then poured into water, whereupon crystals were deposited. These crystals were recrystallized from n-hexane to obtain 18.3 g of maleic ester amide.

Then, 17.4 g of the maleic ester amide as prepared above was mixed with 4.4 g of sodium hydrogensulfite, 6 ml of water and 10 ml of ethanol. The resulting mixture was refluxed for 10 hours to obtain a uniform solution. After the reaction solution was concentrated under reduced pressure, 50 mg of ethanol was added thereto, and insoluble products were filtered off and the ethanol was distilled away under reduced pressure to obtain 20.1 g of Compound (3).

PREPARATION EXAMPLE 3

Preparation of Compound (10)

Using 39.2 g of maleic anhydride and 110.4 g of 2-(1,1,5-trihydro-octafluoropentyloxy)ethanol, 115 g of maleic acid monoester was prepared in the same manner as in Preparation Example 1.

Then, 19.3 g of an acid chloride of maleic acid monoester was prepared from 18.7 g of the maleic acid monoester as prepared above and 10.5 g of phosphorus pentachloride in the same manner as in Preparation Example 1.

Then, 26.5 g of maleic ester amide was prepared from 19.3 g of the acid chloride as prepared above and 9.3 g of n-dodecylamine in the same manner as in Preparation Example 1.

Then, sodium hydrogensulfite was added to 21.7 g of the maleic acid amide as prepared above in the same manner as in Preparation Example 1 to obtain 23.5 g of Compound (10).

The compound of the present invention is added to a coating solution directly or after being dissolved in water, methanol, ethanol, isopropanol, dimethylformamide (DMF), acetone, ethyl acetate or a mixture of such an organic solvent and water. The amount of the compound added is 0.001 to 5% (weight/volume), preferably 0.005 to 2%, based on the coating solution. The addition of the compound may be performed just before the preparation of the coating solution, or during the preparation, or after the preparation.

The compounds of the present invention may be used alone, in admixture with each other, or in combination with other known surface active agents. Examples of such known surface active agents include anionic surface active agents, e.g., saponin and alkylsulfosuccinic acid-, alkylarylsulfonic acid-, alkylsulfonic acid-, amidosulfonic acid-, phosphate-, alkylcarboxylic acid-, and fluorinated alkylcarboxylic acid-based surface active agents, nonionic surface active agents, e.g., polyethylene glycol-, polyoxyethylene alkyl ester-, polyoxyethylene alkyl ether-, polyoxyethylene alkylaryl ether-, sorbitan ester-, polyoxyethylene sorbitan ester-, polyglycerine-, and sugar-based surface active agents, and betaine-based surface active agents, e.g., carboxylic acid-, sulfate-, sulfonate-, and phosphate-type surface active agents. In addition, polymer-type surface active agents may be used.

Addition of higher alcohols to the compound of the present invention sometimes improves the coating performance thereof. Higher alcohols which can be used include amyl alcohol, cyclohexanol, 2-ethylhexanol, cetyl alcohol, stearyl alcohol, linalool, oleyl alcohol, and 2,2,3,3,4,4,5,5,6,6,7,7-dodecafluoropentanol.

The term "hydrophilic organic colloid layer" as used herein refers to a photographic layer prepared using a hydrophilic organic colloid as a binder, for example, as described in *Research Disclosure,* p. 26, (Dec. 1978). As the hydrophilic organic colloid, gelatin is often used. Other hydrophilic organic colloids which can be used include cellulose derivatives, alginic acid salts, hydrophilic synthetic polymers (e.g., polyvinyl alcohol, polyvinyl pyrrolidone, polystyrenesulfonic acid, a styrenesulfonic acid copolymer, a maleic acid copolymer, an acrylic acid copolymer, a methacrylic acid copolymer, and an itaconic acid copolymer), and modified gelatin (e.g., phthalated gelatin). These hydrophilic organic colloids except for gelatin are used alone or as a mixture comprising two or more thereof, but usually in combination with gelatin.

In some cases, polymer latex (e.g., polymethyl methacrylate latex and polyethyl acrylate latex) is added to the hydrophilic organic colloid layer to improve the physical properties and so forth of the photographic layer. Examples of such polymer latex are described, for example, in U.S. Pat. Nos. 2,376,005, 2,739,137, 2,853,457, 3,062,674, 3,411,911, 3,488,708, 3,607,290, 3,635,715, 3,645,740 and 3,525,620, and British Pat. Nos. 1,186,699 and 1,307,373.

As the gelatin, acid-processed gelatin and enzyme-processed gelatin as described in *Bull. Soc. Sci. Phot. Japan,* No. 16, p. 30 (1966) as well as limeprocessed gelatin can be used. In addition, hydrolytic products and enzymatic decomposition products of gelatin can be used. Gelatin derivatives which can be used are prepared by reacting gelatin, for example, with acid halides, acid anhydrides, isocyanates, bromoacetic acid, alkanesultones, vinylsulfonamides, maleinimide compounds, polyalkylene oxides, and epoxy compounds.

Examples of these hydrophilic organic colloid layers include a photographic silver halide light-sensitive layer and an auxiliary photographic light-insensitive layer (e.g., a protective layer, an intermediate layer, an irradiation-preventing layer, an antihalation layer, a back layer, a development contamination-preventing layer, a barrier layer, a supercoat layer, and a subbing layer).

Silver halide emulsions which can be used in the present invention are those photographic emulsions composed of silver halide such as silver bromide, silver iodide, silver chloride, and mixtures thereof, i.e., silver chlorobromide, silver iodobromide and silver chloroiodobromide, for example, as described in *Research Disclosure,* pp. 22–23 (Dec. 1978).

In the case of color light-sensitive materials, in addition to such light-sensitive emulsion layers, an intermediate layer to prevent color-intermingling, a filter layer, a mordant dye layer, and a colored layer containing hydrophobic dye can be provided.

The light-sensitive emulsion as used herein is coated on a suitable support. Supports which can be used include a cellulose acetate film, a polyethylene terephthalate film, a polyethylene film, a polypropylene film, a glass dry plate, a baryta paper, a resin-laminated paper, and a synthetic paper.

In the course of forming a color image with the photographic light-sensitive material of the present invention, a developer capable of reducing silver halide grains into silver is used. In the case of black-and-white development, those developers containing polyhydroxybenzenes, N-alkylaminophenols, 1-phenyl-3-pyrazolidones, or mixtures thereof as developing agents can be used. In the case of color development, those developers containing paraphenylenediamine derivatives, such as 4-amino-N,N-diethylaniline, 4-amino-3-methyl-N-methyl-N-(β-methylsulfonamidoethyl)aniline, 4-amino-3-methyl-N-ethyl-N-(β-hydroxyethyl)aniline, 4-hydroxyaniline, and 4-hydroxy-2,6-dibromoaniline as developing agents can be used.

The photographic light-sensitive material of the present invention is typically processed at temperatures of from 20° C. to 30° C., although it can be processed at higher temperatures, e.g., 30° C. to 60° C. or more.

Suitable processing steps which can be used in processing the color light-sensitive material of the present invention are described, for example, in Japanese Patent Publication No. 35749/70, U.S. Pat. No. 3,695,883, West German Patent Application (OLS) Nos. 2,211,815 and 2,215,382, H. Gordon, *The British Journal of Photography,* pp. 558 et seq., published on Nov. 15, 1954, pp. 440 et seq., published on Sep. 9, 1955, and pp. 2 et seq., published on Jan. 6, 1956, S. Horwitz, ibid., pp. 212 et seq., published on Apr. 22, 1960, E. Gehret, ibid., pp. 122 et seq., published on Mar. 4, 1960, and pp. 396 et seq., published on May 7, 1965, J. Meech, ibid., pp. 182 et seq., published on Apr. 3, 1959, and West German Patent Application (OLS) No. 2,238,051.

Color photographic light-sensitive materials prepared using the compounds of the present invention have the advantage that the silver image formed (or reduced silver) can be easily bleached.

The technique of the present invention can be applied to a color negative light-sensitive material, a color reversal light-sensitive material, a color direct positive light-sensitive material, a transparent color positive light-sensitive material, a color paper light-sensitive material, a DTR (diffusion transfer reversal) type light-sensitive material for instant photography, an X-ray color light-sensitive material, a monochromatic industrial photographic material, and so forth. When a developer, an antioxidant, and a filter dye are used, the technique of the present invention can also be applied to a black-and-white light-sensitive material and an unconventional light-sensitive material.

Since the compound of the present invention has high surface activity, it is desirably used for the coating of a hydrophilic organic colloid layer which is prepared by dissolving or dispersing a water-sparingly-soluble photographic additive in a high boiling point organic solvent.

Water-sparingly-soluble photographic additives as used herein include oil-soluble color couplers, antioxidants for use in preventing color fog or color-intermingling, discoloration-preventing agents (e.g., alkylhydroquinones, alkylphenols, chromans, and cumarones), hardeners, oil-soluble filter dyes, oil-soluble ultraviolet ray-absorbing agents, DIR (development inhibitor releasing) compounds (e.g., DIR hydroquinones and colorless DIR compounds), developers, dye developers, DRR (dye releasing redox) compounds, and DDR (dye diffusible redox) couplers.

Oil-soluble color couplers which can be used include benzoylacetanilide-, pivaloylacetanilide-, pyrazolone-, cyanoacetyl-, phenol-, and naphthol-based compounds. Typical examples of such oil-soluble color couplers are described, for example, in U.S. Pat. Nos. 2,875,057, 3,408,194, 3,582,322, 3,891,445, 2,600,788, 3,062,653, 3,311,476, 3,519,429, 3,558,319, 3,615,506, 3,834,908, 2,369,929, 2,474,293, 2,895,826, 3,591,383, 3,227,544, and 3,790,384.

High boiling point organic solvents as used herein include alkyl phthalates (e.g., dibutyl phthalate and dioctyl phthalate), phosphates (e.g., diphenyl phosphate, triphenyl phosphate, tricresyl phosphate, dioctylbutyl phosphate, and tricyclohexyl phosphate), citrates (e.g., acetyl citrate, tributyl citrate, and trioctyl citrate), benzoates (e.g., octyl benzoate), and alkylamides (e.g., diethyllaurylamide).

The hydrophilic colloid coating solution as used herein can contain a hardener, a dye, a matting agent, light-sensitive silver halide particles, other surface active agents, polymer latex and the like.

These additives can be selected referring to *Product Licensing Index,* Vol. 92, pp. 107–110 (Dec. 1971).

The following examples are provided to illustrate the present invention in greater detail.

EXAMPLE 1

To a photographic emulsion containing 7 wt% of gelatin, and 8 wt% of silver iodobromide (silver iodide, 1.5 mol%) were added additives such as a stabilizer and a hardener. The resulting mixture was divided into 6 portions.

With three of the portions thus-divided, each of Compounds (1), (3) and (13) as listed hereinbefore was added, respectively, as an aqueous solution so that the amount be 10 mg/m$^2$. With the two of the remaining three portions, each of the comparative compounds (A) and (B) as shown below was added as an aqueous solution so that the amount be 10 mg/m$^2$. The one remaining portion was used as a control as is, i.e., without addition of any compound.

These six photographic emulsions were each coated at a rate of 50 meters per minute on one side of a polyethylene terephthalate base which had been provided with a subbing layer and dried to provide Samples 1 to 6.

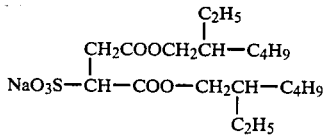

Comparative Compound (A)

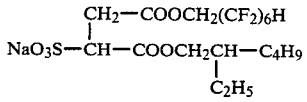

Comparative Compound (B)

These samples were exposed to light through a filter, Filter-SP-14, produced by Fuji Photo Film Co., Ltd. in an exposure amount of 1.6 CMS (candela meter per second) by the use of a tungsten lamp, developed with a developer having the composition shown below at 35° C. for 30 seconds, fixed and washed with water. The sensitivity and fog were measured to examine the influences of the compounds added on photographic characteristics.

| Composition of Developer | |
|---|---|
| Hot water | 800 ml |
| Sodium tetrapolyphosphate | 2.0 g |
| Anhydrous sodium sulfite | 50 g |
| Hydroquinone | 10 g |
| Sodium carbonate monohydrate | 40 g |
| 1-Phenyl-3-pyrazolidone | 0.3 g |
| Potassium bromide | 2.0 g |
| Water to make | 1,000 ml |
| (pH 10.2) | |

The coating properties and photographic properties of the samples are shown in Table 1.

TABLE 1

| No. | Compound Added | Amount ($mg/m^2$) | Coating Properties: Number of Repellencies (per square meters) | Coating Properties: Insufficient Coating on Both Ends of Base Film* | Coating Properties: State of Surface | Photographic Properties: Specific Sensitivity | Photographic Properties: Fog |
|---|---|---|---|---|---|---|---|
| 1 | — | — | 35 | C | C | 100 | 0.14 |
| 2 | Compound (1) | 10 | 0 | A | A | 101 | 0.14 |
| 3 | Compound (3) | 10 | 0 | A | A | 100 | 0.13 |
| 4 | Compound (13) | 10 | 1 | A | A | 100 | 0.14 |
| 5 | Comparative Compound (A) | 10 | 6 | B | B | 99 | 0.16 |
| 6 | Comparative Compound (B) | 10 | 5 | B | B | 100 | 0.15 |

*The term "insufficient coating on both ends of a base film" as used herein indicates the condition that an emulsion is not coated on both ends of a base film.

The insufficient coating on both ends of base film was evaluated as follows:

A: The insufficient coating on both ends of base film was not observed.

B: The insufficient coating on both ends of base film was slightly observed.

C: The insufficient coating on both ends of base film was remarkably observed.

Furthermore, the state of surface was evaluated as follows:

A: The state of surface was good.

B: The state of surface was fair.

C: The state of surface was bad.

With the light-sensitive materials of the present invention, problems such as repellency and insufficient coating on both ends of a base film arising in coating at a high speed are significantly reduced, and they exhibit excellent coating properties and exert no adverse influences on photographic characteristics.

EXAMPLE 2

With each of Samples 1 to 6 as used in Example 1, the antistatic properties were examined by the following method.

Two unexposed test pieces were bonded together with a double-coated tape in such a manner that a protective layer of each test piece was exposed outside, conditioned for 2 hours at 25° C. and 25% RH, and passed between two rotating white rubber rolls in a dark room air-conditioned under the same conditions as above. Thereafter, the quantity of charge was determined with an electrometer in a Faraday box. Subsequently, the sample was developed with the same developer as used in Example 1, fixed and washed with water, and the formation of static marks was examined.

The results are shown in Table 2.

TABLE 2

| No. | Compound Added | Amount ($mg/m^2$) | Antistatic Properties: Quantity of Charge ($c/cm^2$) | Degree of Formation of Static Marks |
|---|---|---|---|---|
| 1 | — | — | $+1.8 \times 10^{-10}$ | D |
| 2 | Compound (1) | 10 | $-0.05 \times 10^{-10}$ | A |
| 3 | Compound (3) | 10 | $+0.08 \times 10^{-10}$ | A |
| 4 | Compound (13) | 10 | $-0.02 \times 10^{-10}$ | A |
| 5 | Comparative Compound (A) | 10 | $+3.1 \times 10^{-10}$ | D |
| 6 | Comparative Compound (B) | 10 | $-0.15 \times 10^{-10}$ | B |

The degree of formation of static marks was evaluated as follows:

A: The formation of static marks was not observed.

B: The formation of static marks was slight.

C: The formation of static marks was significant.

D: The formation of static marks occurred over almost the entire surface.

It can be seen from Table 2 that with the samples containing the compounds of the present invention, the quantity of charge was low and the formation of static marks were not observed, and thus the compounds of the present invention have an excellent antistatic effect.

EXAMPLE 3

After the preparation of a photographic emulsion containing 6 wt% of gelatin and 7 wt% of silver iodobromide (silver iodide, 5 mol%) which was subjected to a second ripening by the usual method such as gold sensitization or sulfur sensitization, a 4 wt% aqueous solution of saponin as a coating aid was added to the photographic emulsion in an amount of 5 ml per kilogram of the photographic emulsion. The thus-prepared photographic emulsion, and a protective layer-forming solution prepared by adding 0.1 g of a hardener, 2,4-dichloro-6-hydroxy-1,3,5-triazine sodium salt and the compound of the present invention shown in Table 3 in the amount shown in Table 3 to a 2% gelatin solution, each being per kilogram of the 2% gelatin solution, were multilayer-coated by the slide hopper method at the same time. Separately, two gelatin solutions containing the hardener and Comparative Compounds (A) or (B) used in Example 1 were prepared. These comparative protective layer-forming solutions and the same photographic emulsion as used above were multilayer-coated at the same time.

After drying, the coating properties were examined, and a contact angle relative to a developer was measured. The results are shown in Table 3.

The contact angle was measured as follows:

A test piece was placed horizontally, and a developer (D-72, a developer appointed by Eastman Kodak) was dropped on the test piece. Then, the contact angle was measured by the use of a contact angle-measuring apparatus (produced by Elma Optics Co., Ltd.).

The smaller the contact angle, the better are the wetting and extension of the developer onto the film during the development thereof, and this also indicates that uneven development and the formation of air bubbles in the film surface are reduced.

TABLE 3

| No. | Compound Added | Amount Added to Protective Layer ($mg/m^2$) | Coating Properties: Number of Repellencies (per square meters) | Coating Properties: Insufficient Coating on Both Ends of Base Film | Coating Properties: State of Surface | Contact Angle (°) |
|---|---|---|---|---|---|---|
| 1 | Compound (4) | 10 | 0 | A | A | 30 |
| 2 | Compound (7) | 10 | 1 | A | A | 32 |
| 3 | Compound (10) | 10 | 0 | A | A | 29 |
| 4 | Comparative Compound (A) | 10 | 5 | B | B | 40 |
| 5 | Comparative Compound (B) | 10 | 3 | B | B | 35 |

The insufficient coating on both ends of base film or the state of surface as evaluated in the same manner as in Example 1.

It can be seen from Table 3 that with the samples containing the compound of the present invention in the protective layer, coating problems such as repellency and insufficient coating on both ends of a base film are reduced even under miltilayer coating conditions of a gelatin-containing colloid solution, and thus it is possible to perform uniform coating. Furthermore, it can be seen that the contact angles of the present samples are small as compared with the comparative samples, and the formation of problems during development is reduced.

EXAMPLE 4

An emulsion having the composition shown below was coated at a rate of 40 meters on one side of a cellulose triacetate support on which an antihalation layer had been provided to prepare Samples 1 to 5.

| Composition of Emulsion | | |
|---|---|---|
| Binder: | Gelatin | 7 $g/m^2$ |
| Hardener: | 1,3-Bis(vinylsulfonyl)-2-propanol | 1.2 g/100 g-binder |
| Amount of silver coated: | | 3.1 $g/m^2$ |
| Composition of silver halide: | | |
| AgI: 2 mol % | | |
| AgBr: 98 mol % | | |
| Antifoggant: | 4-Hydroxy-6-methyl-1,3,3a,7-tetraazaindene | 0.9 g/Ag 100 g |
| Coupler: | 1-Hydroxy-4-(2-acetylphenyl)azo-N—[4-(2,4-di-tert-amylphenoxy)butyl]-2-naphthamide | 38 g/Ag 100 g |
| Sensitizing Dye: | Anhydro-5,5'-dichloro-9-ethyl-3,3'-di(3-sulfopropyl)thiacarbocyaninehydroxy.pyridinium salt | 0.3 g/Ag 100 g |

Sample 1 was composed of the above ingredients alone. Samples 2 and 3 were each composed of the above ingredients, and further contained 10 $mg/m^2$ of Compounds (8) and (9), respectively. Samples 4 and 5 were each composed of the above ingredients, and further contained 10 $mg/m^2$ of Comparative Compounds (A) and (B), respectively.

The coating properties of Samples 1 to 5 were examined, and the results are shown in Table 4.

TABLE 4

| No. | Compound Added | Amount ($mg/m^2$) | Number of Repellencies | Insufficient Coating on Both Ends of Base Film | State of Surface |
|---|---|---|---|---|---|
| 1 | — | — | 55 | C | C |
| 2 | Compound (8) | 10 | 0 | A | A |
| 3 | Compound (17) | 10 | 1 | A | A |
| 4 | Comparative Compound (A) | 10 | 11 | B | B |
| 5 | Comparative Compound (B) | 10 | 7 | B | B |

The insufficient coating on both ends of base film or the state of surface was evaluated in the same manner as in Example 1.

It can be seen from Table 4 that even silver halide light-sensitive materials containing lipophilic color couplers prepared according to the present invention exhibit excellent coating properties, i.e., are free from coating problems such as repellency and insufficient coating on both sides of a base film.

While the invention has been described in detail and with reference to specific embodiments thereof, it will be apparent to one skilled in the art that various changes and modifications can be made therein without departing from the spirit and scope thereof.

What is claimed is:

1. A photographic silver halide light-sensitive material comprising a support and at least one silver halide emulsion layer on the support, wherein the emulsion layer or another hydrophilic organic colloid layer contains a compound represented by formula (I)

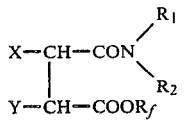

(I)

wherein $R_1$ and $R_2$ represent the same or different groups and are each hydrogen, an alkyl group, or an aryl group, or $R_1$ and $R_2$ can be linked together to form an N-containing heterocyclic ring, provided that $R_1$ and $R_2$ are not both hydrogens; $R_f$ is a fluorine-containing alkyl group; one of X and Y is a hydrogen atom and another is a $—SO_3M$ group wherein M is a cation.

2. A photographic silver halide light-sensitive material as in claim 1, wherein $R_1$ and $R_2$ are each hydrogen, a substituted or unsubstituted alkyl group containing from 1 to 30 carbon atoms, or a substituted or unsubstituted aryl group containing from 6 to 24 carbon atoms.

3. A photographic silver halide light-sensitive material as in claim 1, wherein $R_1$ and $R_2$ are linked together to form a piperidine ring or an N-alkylpiperazine ring.

4. A photographic silver halide light-sensitive material as in claim 1, 2, or 3, wherein $R_f$ is an alkyl group containing 4 or more fluorine atoms and from 3 to 30 carbon atoms.

5. A photographic silver halide light-sensitive material as in claim 4, wherein the substituents of $R_f$ is solely fluorine atoms.

6. A photographic silver halide light-sensitive material as in claim 1, 2, or 3, wherein M is selected from the group consisting of hydrogen, an alkali metal cation, an alkaline earth metal cation, ammonium, and an amino group.

7. A photographic silver halide light-sensitive material as in claim 4, wherein M is selected from the group consisting of hydrogen, an alkali metal cation, an alkaline earth metal cation, ammonium, and an amino group.

* * * * *